United States Patent [19]

Kimblin

[11] 3,980,850

[45] Sept. 14, 1976

[54] VACUUM INTERRUPTER WITH CUP-SHAPED CONTACT HAVING AN INNER ARC CONTROLLING ELECTRODE

[75] Inventor: Clive W. Kimblin, Pittsburgh, Pa.

[73] Assignee: Westinghouse Electric Corporation, Pittsburgh, Pa.

[22] Filed: Dec. 19, 1974

[21] Appl. No.: 534,550

[52] U.S. Cl. ..... 200/144 B; 200/279

[51] Int. Cl.[2] ..... H01H 33/66; H01H 1/06

[58] Field of Search ..... 200/144 R, 144 A, 144 B, 200/279

[56] References Cited

UNITED STATES PATENTS

| | | | |
|---|---|---|---|
| 2,900,476 | 8/1959 | Reece | 200/144 B |
| 3,089,936 | 5/1963 | Smith, Jr. | 200/279 X |
| 3,182,156 | 5/1965 | Lee et al. | 200/279 X |
| 3,225,167 | 12/1965 | Greenwood | 200/144 B |
| 3,869,589 | 3/1975 | Hundstad | 200/144 B |

FOREIGN PATENTS OR APPLICATIONS

| | | | |
|---|---|---|---|
| 1,480,959 | 5/1967 | France | 200/144 B |
| 1,410,884 | 8/1965 | France | 200/144 B |
| 964,405 | 7/1964 | United Kingdom | 200/144 B |
| 1,090,872 | 11/1967 | United Kingdom | 200/144 B |

*Primary Examiner*—James R. Scott
*Attorney, Agent, or Firm*—W. A. Elchik

[57] ABSTRACT

A vacuum interrupter is described having improved electrodes. The electrodes are of the cup-shaped type with an insert electrode disposed within the cup-shaped contact closely spaced from the base portion of the cup. The insert electrode has spiral or radial and circumferential extending slots therein. The spirals or slots of the insert electrodes may extend in the same or opposed directions.

13 Claims, 5 Drawing Figures

VACUUM INTERRUPTER WITH CUP-SHAPED CONTACT HAVING AN INNER ARC CONTROLLING ELECTRODE

BACKGROUND OF THE INVENTION

1. Field of the Invention

This invention relates to a vacuum-type circuit interrupter and more particularly to an improved construction of the contacts for increased current interrupting ability.

2. Description of the Prior Art

In the usual vacuum-type circuit interrupter, an envelope or housing is fabricated from a suitable insulating material such as glass, ceramic or the like. The housing forms a vacuum chamber in which a pair of separable contacts are disposed. In the closed position, direct electrical contact exists between the contacts of the interrupter and a continuous current path is established through the interrupter. In the open circuit position the contacts are spaced apart, forming an arcing gap therebetween. During operation, current interruption is initiated by separating the contacts. When the contacts separate, an arc is formed across the arcing gap. The arc which is formed vaporizes a portion of the contact material and these particles become ionized to help sustain the arc through which current flows until current interruption. Current interruption normally occurs at a current zero of the alternating current wave. After the current zero point has been reached, recovery voltage transients begin building up between the separated contacts. If the dielectric strength of the arcing gaps is sufficiently strong to withstand recovery voltage transients, breakdown will not occur, the arc will not reignite and circuit interruption will be complete. During circuit interruption, as the relatively movable contacts are separated an arc is formed therebetween and current will continue to flow through this arc until the arc is extinguished. The contact must support the arc from its initiation at contact separation until its extinction at approximately current zero. While the arc is being sustained the contacts are subject to very intense heating. The arc energy causes melting, erosion, and general deterioration of the contact surfaces. It is known in the prior art that contrate or cup-shaped contacts provide high current interruping ability. Slots formed in the cup-shaped contact can drive the arc around the electrode periphery and also drive the arc towards the center of the contact. When the arcs are forced radially inward, as disclosed in some prior art contact patents, they tend to grossly erode the inside base of the cup-shaped contact.

A prior art method of minimizing deterioration of the contact surface is with an axial magnetic field in phase with the arc current, reducing arc voltage and the power dissipated within the vacuum interrupter during the circuit interruption. It is known that the axial magnetic field in phase with the arc current can increase interruption capacity of vacuum interrupters. In the prior art, these fields have been created by coils inserted in the supporting stem of the contact or by external coil fields. In both cases, the coils conduct current even when the arcing contacts are closed and consequently represent a permanent energy loss due to the resulting eddy currents. It is desirable to have a contact which produces an axial magnetic field in place with the arc current only during arcing. It is also desirable to have a cup-shaped contact which has an inner base area which is not grossly eroded during high current interruption.

SUMMARY OF THE INVENTION

A contact for a vacuum-type circuit interrupter is disclosed, which is of a generally cup-shape and includes a spiral type electrode within the confines defined by the outer cup-shaped portions. The inner spiral insert which is recessed from the contact making surface can either be directly connected to the inner diameter of the side walls or to the base of the contact. The inner spiral electrode is supported around its periphery within the cup-shaped contact. A pair of mating contacts are normally used in the vacuum interrupter. The spirals on the insert of the disclosed contact can be disposed in opposing directions for a pair of mating contacts. The vacuum-type circuit interrupter thus constructed, utilizes a pair of unitary contacts which produce an axial magnetic field in phase with the arcing current during high circuit interruption. If the side walls of the cup-shaped contact are not slotted, there is no magnetic force produced when the contacts are normally closed. When the spirals, on the internal insert electrodes of the pair of mating contacts, are opposing a strong axial magnetic component during periods of high current arcing is produced.

In one embodiment of the invention, a vacuum-type circuit interrupter comprises a pair of relatively movable contacts wherein, one contact is constructed with a cup-shape, having an annular contact surface and an inner spiral electrode recessed from and contained within the cup-shaped outer contact. The mating contact is similarly constructed so that when the pair of contacts are disposed in a vaccum interrupter, the spirals are opposing. The outer cup-shaped portion of each contact can have slots formed therein which tend to move arcs formed during interruption in a radial and circumferential direction. The advantages of this type of construction are: (1) the radial component of the magnetic field will be retained during low current arcings on the contact surface; (2) at high current, when the arc transfers into the internal structure of the contact, an axial magnetic field will be created. This axial magnetic field produced by the spiral insert will significantly reduce the arc voltage and increase the threshold column for anode spot formation. Postponement of the anode spot formation will reduce the gross erosion at both the anode and cathode contact; (3) the axial magnetic field will be generated only at high current, during the arcing half-cycle. In particular, there will be little permanent eddy current loss during operation with the contacts closed. The axial magnetic component will only be produced when high currents are being interrupted and the arc is transferred to the inner electrode area.

It is an object of this invention to disclose a vacuum-type circuit interrupter wherein a pair of contacts produce a radial magnetic field during high current interruption.

It is a further object of this invention to disclose a construction of vacuum interrupter contact which produces an axial magnetic field during circuit interruption when high current arcing occurs and which produces no axial magnetic field when the vacuum interrupter is normally closed.

It is a further object of this invention to disclose a vacuum interrupter utilizing a pair of unitary contacts which produce an axial magnetic field during arcing.

BRIEF DESCRIPTION OF THE DRAWINGS

For a better understanding of the invention, reference may be had to the preferred embodiment exemplary of the invention shown in the accompanying drawing which.

DESCRIPTION OF THE PREFERRED EMBODIMENTS

Figure 1:
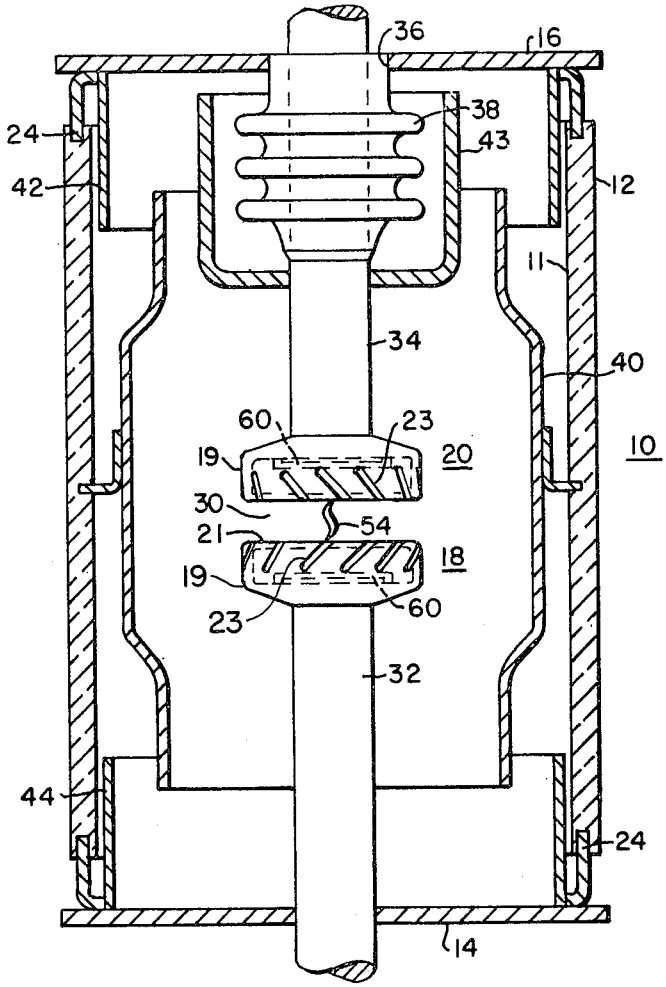
FIG. 1 is a sectional view of a vacuum-type circuit interrupter utilizing the teachings of the present invention.

Referring now to the drawings, and FIG. 1 in particular, there is shown a vacuum-type circuit interrupter 10 utilizing the teachings of the present invention. Vacuum circuit interrupter 10 comprises a highly evacuated tubular envelope 12 formed from glass, ceramic, or other suitable material and a pair of metallic end caps 14 and 16 closing off the ends of the insulating envelope 12. Suitable seal means 24 are provided between the end caps 14 and 16 and the insulating envelope to render the inside of the insulating envelope 12 vacuum tight. The pressure within the insulating envelope 12 under normal conditions is lower than $10^{-4}$ Torr to insure that the mean free path for electron travel will be longer than the potential breakdown path within the insulating envelope 12. Located within the insulated envelope 12 are a pair of relatively movable contacts 18 and 20. When the contacts 18 and 20 are separated, there is formed an arcing gap therebetween. The lower contact 18 is a stationary contact secured to a conducting rod 32 by suitable connecting means such as welding, brazing or the like. The conducting rod 32 is rigidly joined to the stationary end cap 14 by suitable means such as welding or brazing. The upper contact 20 is a movable contact and is joined to a conductive operating rod 34. The operating rod 34 is suitably mounted for movement along the longitudinal axis of the insulating envelope 12. Operating rod 34 projects through an opening 36 and bellows end cap 16 as shown. A metal bellows 38 is secured in sealing relationship at its respective opposite ends to the operating rods 34 and to the bellows end cap 36. Flexible metallic bellows 38 provides a seal around the operating rod 34 to allow for movement of operating rod 34 without impairing the vacuum within the insulating envelope 12.

Coupled to the end of the operating rod 34 is a suitable actuating means (not shown) provided for driving the movable contact 20 into engagement with the stationary contact 18 so as to close the interrupter 10. The actuating means is also capable of returning the movable contact 22 to the open circuit position during circuit interruption.

When the contacts 18 and 20 are separated during circuit interruption, an arc 54 is formed in the arcing gap 30 between contacts 18 and 20. The arc 54, which is formed between the contacts 18 and 20 vaporizes some of the contact material. These vapors and particles are dispersed from the arcing gap 30 toward the insulating envelope 12. The internal insulating surfaces of the insulating envelope 12 are protected from the condensation of the arc generated metallic vapors and particles thereon by means of a tubular main metallic shield 40. Arcing shield 40 as shown in FIG. 1 is suitably supported on the insulating envelope 12 and electrically isolated from end gaps 14 and 16, but may be supported from or electrically connected to either end cap 14 or 16, if desired. Metallic shield 40 acts to intercept and to condense arc generated metallic vapors and particles before they can reach the insulating envelope 12. To further reduce the chances for vapors or particles reaching the insulating envelope 12, by bypassing the shield 40, end cap shields 42 and 44 are provided surrounding the ends of the main arc shield 40. A cup-shaped shield 43 is attached to the movable operating rod 34 and partially surrounds the flexible metallic bellows 38 to prevent the bellows 38 from being bombarded by arc generated metallic vapors and particles.

During circuit interruption, the movable contact 20 separates from the stationary contact 18 and arcs develop across the arcing gap 30. The arcs 54 vaporize some of the material from the contacts 18 and 20 and the resulting metallic vapors and particles can conduct current until circuit interruption.

Figure 3:
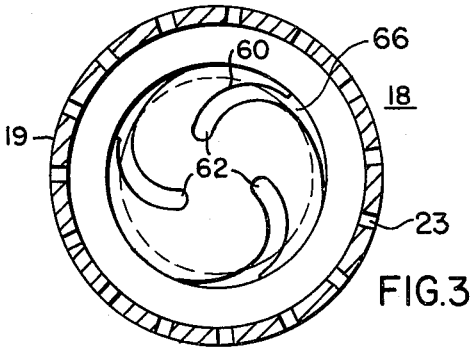
FIG. 3 is a sectional view of the vacuum interrupter contact shown in FIG. 2 along the lines III—III.
Figure 2:
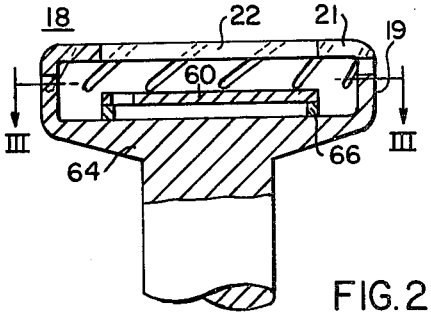
FIG. 2 is a sectional view of a vacuum interrupter contact constructed in accordance with the teachings of the present invention.

The contacts shown in FIG. 1 and in more detail in FIGS. 2 and 3 have a general cup-shape, with side walls 19, a reentrant lip portion 21 and an open center 22. A spiral electrode insert 60 is disposed within the open center portion of contact 18. Angled slots 23 are cut in the side walls 19 of contacts 18 and 20. A pair of contacts 18 and 20 are mounted face-to-face in the vacuum interrupter 10. As shown in FIG. 1, the slots 23 of contacts 18 and 20 point in the same circumferential direction. This produces a magnetic field to rapidly rotate arcs formed, in a circumferential and radial direction around the annular contact surface 21. The spirals 62 formed in the electrode insert 60 of contacts 18 and 20 point in opposite circumferential directions. Having the spiral 62 point in the opposite direction produces a magnetic field with a strong axial component when the inner electrode arcing occurs between electrode inserts 60 of contacts 18 and 20. Insert 60 is supported from the base 64 of contact 18 or 20 by conducting supports 66. Supports 66 connect to the outer periphery of the spiral insert 60.

A contact construction as disclosed herein drastically reduces the amount of arc erosion of the base 64 of contacts 18 or 20. Reducing erosion of base 64 enhances the interrupters switching ability. The spiral type electrodes 60 which are connected to the contact base 64 and supported at the periphery by the ends of the spirals provide an axial magnetic force during high current arcing. Placing the spirals of the insert electrode 60 in the opposing direction provides an axial magnetic field which is generated during high current periods. Contacts constructed in accordance with the present invention have advantages, such as: (1) the radial component of the magnetic field will be provided during low current arcing to rotate the arc on the annular contact surface 21; (2) during high current arcing the arc will be transferred into the internal structure of contacts 18 and 20 to spiral electrodes 60 and the axial magnetic field will be created. The axial magnetic field created during high current will significantly reduce the arc voltage, and increase the threshold current for anode spot formation. Increasing the current at which anode spot formation occurs reduces erosion at both the anode and cathode contacts 18 or 20; (3) the axial magnetic field will be generated only during the high current arcing half cycles. There will be no permanent eddy current loss when the electrodes are in the normal closed position. There will be little erosion of the electrode lip 21 due to the arc 54 at low current arcing, since the radial magnetic field keeps the arc 54 moving.

The insert electrode 60 for the contacts shown in FIS. 1 thru 3 can have the spiral slots pointing in the same direction, if desired. This will produce a magnetic field with a strong radial component for rapidly moving the arc. Thus a strong radial magnetic field, to move the arc in a circumferential direction, will be provided if the arcs are on the lip portion 21 or on the electrode insert 60.

Figure 5:
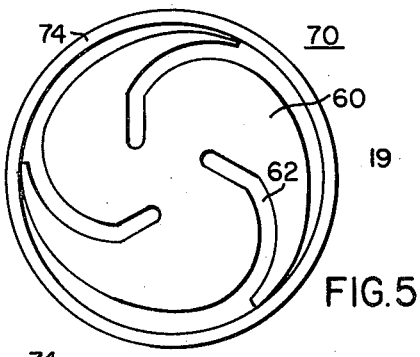
Figure 4:
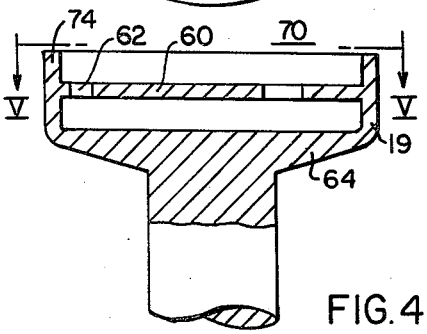
FIG. 4 is a sectional view of a vacuum interrupter contact illustrated in another embodiment of the present invention; and, FIG. 5 is a top view of the contact shown in FIG. 4 along the lines V—V.

Referring now to FIGS. 4 and 5, there is shown another embodiment of the invention utilizing the teaching of the present invention. The generally cup-shaped contact 70 is provided with an internal electrode insert 60 directly connected to the side wall 19. Side wall 19 extends from base 64 of contact 70. Side wall 19 can be slotted if desired. When a pair of contacts 70 as shown in FIG. 4 are mounted in a vacuum interrupter 10 the slots 62 can be mounted in the same direction to produce a strong radial magnetic field. Alternatively, the slots 62 of a pair of mating contacts 70 can also be constructed to point in the opposite direction thus providing a strong axial magnetic field component with the resulting advantages as described above. Contact 70 is provided with an annular contact surface 74. When a pair of contacts 70 are disposed in a vacuum interrupter 10, contact surfaces 74 are in engagement during normal closed operation. The electrode insert 60 is spaced apart from the base portion 64. The spiral insert 60 can be constructed of the same material as the main contact body or of a different material, if desired.

The disclosed contact construction provides for reducing the high current erosion of the base of cup-shaped contacts with an enhancement of the contacts interruption ability and rating. The spiral electrode inserts supported at their peripheries are disposed within the body of the cup-shaped contact to improve interrupter capability. When the slots of the inset 60 are opposing they produce strong axial magnetic fields reducing arcing, postponing anode spot formation and reducing contact erosion.

What we claim is:

1. A vacuum circuit interrupter comprising:

a highly evacuated insulating envelope;

a first contact disposed within said insulating envelope;

a second contact disposed within said insulating envelope being relatively movable with respect to said first contact between a closed position in engagement with said first contact and an open position separated from said first contact to form an arcing gap therebetween, across which an arc is formed during circuit interruption;

said first contact comprising a base portion, a side wall portion extending from said base portion defining a hollow right circular cylinder, an annular contact surface formed at the free end of the side wall portion, an insert portion disposed within and recessed from the contact surface being spaced apart from the base portion and having circumferential and radial extending slots formed therein; and, said second contact comprising a flat circular base portion, a side wall portion extending from the base portion defining a hollow right circular cylinder, an annular contact surface formed at the free end of the side wall portion, an insert portion disposed within and recessed from the annular contact surface being spaced apart from the base portion and having circumferential and radial extending slots formed therein.

2. A vacuum circuit interrupter as claimed in claim 1 wherein:

the insert portion of said first contact has slots which extend generally in a radial and clockwise circumferential direction; and, the insert portion of said second contact has slots formed therein which extend generally in a radial and counterclockwise circumferential direction.

3. A vacuum circuit interrupter as claimed in claim 1 wherein the insert portion of said first contact and the insert of said second contact each have slots formed therein which extend in the same direction.

4. A vacuum circuit interrupter as claimed in claim 1 wherein the insert portion of said first contact and the insert of said second contact each have slots formed therein with the slots of each insert extending in an opposite direction.

5. A vacuum circuit interrupter as claimed in claim 1 wherein:

the insert portion of said first contact is directly connected to and extends radially inward from the inner diameter of the side wall portion; and, the insert portion of said second contact is directly connected to and extends radially inward from the inner diameter of the side wall portion.

6. A vacuum circuit interrupter as claimed in claim 1 comprising:

first support means supporting the insert portion of said first contact from the base portion; and, second support means supporting the insert portion of said second contact from the base portion.

7. A vacuum circuit interrupter as claimed in claim 6 wherein;

the side wall portion of said first contact includes a radially inward extending lip portion which defines the annular contact surface; and, the side wall portion of said second contact includes a radially inward extending lip portion which defines an annular contact surface.

8. A vacuum circuit interrupter as claimed in claim 7 including:

axial magnetic field generating means for generating an axial magnetic field when arcing occurs between the insert of said first contact and the insert of said second contact.

9. A vacuum circuit interrupter as claimed in claim 8 wherein:

the insert portion of said first contact has radial and circumferential slots formed therein; and, the insert portion of said second contact has radial and circumferential slots formed therein extending in the opposite circumferential direction with reference to the insert in said first contact.

10. A contact for a vacuum circuit interrupter comprising:

a flat base portion;

a circular side wall portion, extending from said flat base portion, defining a right circular hollow cylinder; and, an inner circular insert, physically separated from said flat base portion but electrically and structurally connected to said flat base portion, having slots formed therein which extend in a generally radial and circumferential direction.

11. A contact for a vacuum circuit interrupter as claimed in claim 10 wherein:

said inner circular insert is directly connected to the inner diameter of said circular side wall portion; and, said inner circular insert is disposed within the right circular cylinder defined by said circular side wall portion and is recessed from contact surface formed at the free end of said side wall portion.

12. A contact for a vacuum circuit interrupter as claimed in claim 11, wherein said inner circular insert has a diameter less than the inner diameter of said side wall portion and is supported from said flat base portion by electrically conductive support means which extend between said flat base and said inner circular insert.

13. A contact for a vacuum circuit interrupter as claimed in claim 11 comprising;

an inwardly facing lip portion extending radially inward from the free end of said side wall portion; and, a plurality of slots formed in said side wall portion for providing a magnetic force when current flows therethrough.

* * * * *